US010957300B2

(12) United States Patent
Lewis et al.

(10) Patent No.: US 10,957,300 B2
(45) Date of Patent: Mar. 23, 2021

(54) REDUCING FAR-FIELD NOISE PRODUCED BY WELL OPERATIONS

(71) Applicant: Halliburton Energy Services, Inc., Houston, TX (US)

(72) Inventors: Bryan J. Lewis, Duncan, OK (US); Kenneth R. Coffman, Duncan, OK (US); Bruce C. Lucas, Duncan, OK (US); Adam Marks, Duncan, OK (US); Tim H. Hunter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/344,284

(22) PCT Filed: Dec. 13, 2016

(86) PCT No.: PCT/US2016/066311

§ 371 (c)(1),
(2) Date: Apr. 23, 2019

(87) PCT Pub. No.: WO2018/111233

PCT Pub. Date: Jun. 21, 2018

(65) Prior Publication Data

US 2019/0272815 A1 Sep. 5, 2019

(51) Int. Cl.
*G10K 11/178* (2006.01)
*E21B 41/00* (2006.01)

(52) U.S. Cl.
CPC ..... *G10K 11/17823* (2018.01); *E21B 41/00* (2013.01); *G10K 11/17825* (2018.01);
(Continued)

(58) Field of Classification Search
CPC ..... G10K 11/17823; G10K 11/17861; G10K 11/17857; G10K 11/17873;
(Continued)

(56) References Cited

U.S. PATENT DOCUMENTS 5,359,662 A 10/1994 Yuan et al.
5,618,010 A 4/1997 Pla et al.
(Continued)

FOREIGN PATENT DOCUMENTS

JP 2006342592 A 12/2006
JP 2010007421 A 1/2010
(Continued)

OTHER PUBLICATIONS

PCT Application Serial No. PCT/US2016/066311, International Search Report dated Aug. 10, 2017, 3 pages.
(Continued)

*Primary Examiner* — Vivian C Chin
*Assistant Examiner* — Douglas J Suthers
(74) *Attorney, Agent, or Firm* — Gilliam IP PLLC

(57) ABSTRACT

A system for reducing far-field noise produced by well operations includes a passive sound barrier shielding an area, in which the well operations are performed, in an open-air environment. The system further includes a sound sensor to receive near-field noise from the well operations. The system further includes an analysis module, coupled to the sound sensor, to generate an anti-noise signal. The system further includes active anti-noise generators, coupled to the analysis module, to generate anti-noise, based on the anti-noise signal, that destructively interferes with noise from the well operations outside of the passive sound barrier at a predetermined distance from the passive sound barrier. The analysis module generates the anti-noise signal based on the near-field noise, the predetermined distance, and adjustable positions and orientations of the active anti-noise generators.

20 Claims, 6 Drawing Sheets

(52) U.S. Cl.
CPC .. *G10K 11/17857* (2018.01); *G10K 11/17861* (2018.01); *G10K 11/17873* (2018.01); *G10K 11/17881* (2018.01); *G10K 2210/10* (2013.01); *G10K 2210/111* (2013.01); *G10K 2210/3026* (2013.01); *G10K 2210/3044* (2013.01); *G10K 2210/3216* (2013.01); *G10K 2210/3224* (2013.01)

(58) Field of Classification Search
CPC ..... G10K 11/17825; G10K 11/17881; G10K 2210/10; G10K 2210/111; G10K 2210/3026; G10K 2210/3044; G10K 2210/3216; G10K 2210/3224; E21B 41/00
USPC ..... 381/71.1
See application file for complete search history.

(56) References Cited

U.S. PATENT DOCUMENTS

| | | | | |
|---|---|---|---|---|
| 5,699,437 | A | 12/1997 | Finn | |
| 6,343,127 | B1 | 1/2002 | Billoud | |
| 6,917,687 | B2 | 7/2005 | Vaishya | |
| 6,940,983 | B2 | 9/2005 | Stuart | |
| 7,272,234 | B2 | 9/2007 | Sommerfeldt et al. | |
| 8,068,616 | B2 | 11/2011 | Copley et al. | |
| 8,270,625 | B2 | 9/2012 | Sommerfeldt et al. | |
| 9,025,786 | B2 | 5/2015 | Luecking et al. | |
| 2012/0237049 | A1* | 9/2012 | Brown | G10K 11/178 381/71.1 |
| 2019/0078394 | A1* | 3/2019 | Camacho Cardenas | G01H 11/00 |

FOREIGN PATENT DOCUMENTS

| | | | |
|---|---|---|---|
| KR | 1019980072299 | | 10/1999 |
| KR | 101107792 | B1 | 1/2012 |
| WO | 9311529 | A1 | 6/1993 |

OTHER PUBLICATIONS

PCT Application Serial No. PCT/US2016/066311, International Written Opinion dated Aug. 10, 2017, 5 pages.

* cited by examiner

REDUCING FAR-FIELD NOISE PRODUCED BY WELL OPERATIONS

BACKGROUND

In the oil and gas industry, far-field noise produced by well operations may cause numerous and wide-ranging negative effects. For example, the noise may hinder the activities of the surrounding wildlife. Additionally, the noise may hinder the residential or business activities of populated areas. Considering noise regulations of cities, rural areas, and protected wildlife areas, those that cannot control noise produced by well operations are disadvantaged compared to those that can. Specifically, those that cannot control noise do not have the potential to operate in or near the noise-regulated zones without conflicting with regulations.

For example, the migratory paths of certain birds and mammals are protected by regulations that set a maximum threshold of noise that is allowed to enter those paths. Because noise generally attenuates with distance, there is a de facto radial area around any point on the paths in which well operations may not be performed, all other things being equal. Those that cannot control noise produced by well operations cannot remain competitive, compared with those who can, because they cannot shrink such radial area and still comply with such regulations.

BRIEF DESCRIPTION OF THE FIGURES

Accordingly, to mitigate or eliminate the problems identified above, systems and methods for reducing far-field noise produced by well operations are disclosed herein. In the following detailed description of the various disclosed embodiments, reference will be made to the accompanying drawings in which.

Figure 1:
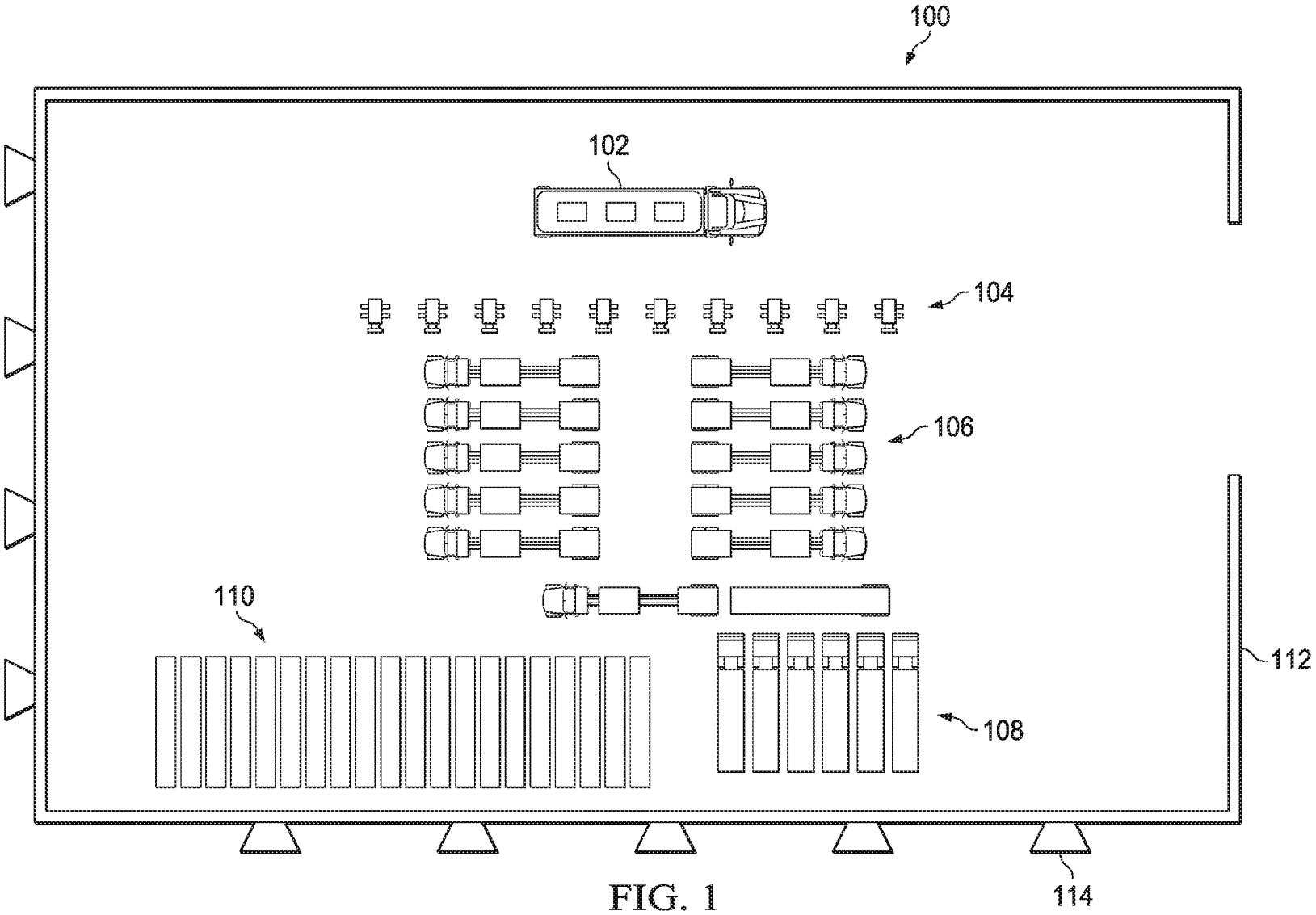
FIG. 1 is a diagram of an illustrative system of reducing far-field noise produced by well operations.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

NOTATION AND NOMENCLATURE

Certain terms are used throughout the following description and claims to refer to particular system components and configurations. As one of ordinary skill will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ". Also, the term "couple" or "couples" is intended to mean either an indirect or a direct electrical or physical connection. Thus, if a first device couples to a second device, that connection may be through a direct electrical connection, through an indirect electrical connection via other devices and connections, through a direct physical connection, or through an indirect physical connection via other devices and connections in various embodiments.

As used herein, the term "reduce" as it applies to the noise produced by well operations means a reduction in whole or fractional decibels and also includes reducing the noise to zero decibels, i.e. entirely eliminating the noise.

DETAILED DESCRIPTION

The issues identified in the background are at least partly addressed by systems and methods of reducing far-field noise produced by well operations. Far-field noise produced by well operations is difficult to reduce because the open-air environment in which well operations are conducted allow the noise to escape in many directions. However, using the concepts disclosed herein, the noise may be reduced or entirely eliminated.

FIG. 1 is a diagram of an illustrative system 100 of reducing far-field noise produced by well operations including a command center 102, wellheads 104, engine and pump equipment 106, sand and chemical additives trailers 108, water containers 110, a passive sound barrier 112, and one or more active anti-noise generators 114.

The command center 102 may include communication and networking devices such as routers, modems, switches, satellites dishes, and the like. These devices may be coupled to sensor and actuator devices throughout the well operations site via wired or wireless connections. The sensor devices may include sensors that measure sound, temperature, pressure, flow-rate, and the like. The actuator devices may include devices that make adjustments, with or without human input, based on feedback from well operations received at the command center 102 and the predicted state of the well operations. For example, the actuator devices may include valves, chokes, engines, pumps, fans, and the like.

The command center 102 may also include various input and output devices to display the current, past, and predicted status of the well operations to on-site or remote workers. Such devices may include displays, printers, keyboards, pointing devices, and the like. The communication and networking devices, when used in conjunction with the input and output devices and various sensor and actuator devices throughout the well operations site, may allow workers to monitor, predict, and modify the status of wellsite operations locally or remotely.

The command center 102 may include one or more processors, coupled to memory, that perform or partially perform an action or calculation described below. As shown, the command center 102 is a truck that can be moved to various places around the wellsite or off the wellsite completely. In other embodiments, the command center 102 is any structure that can include or house the devices described above with the appropriate cables, connectors, power sources, and the like. The command center 102 need not be restricted to the well site, and may even be located in different countries than the country in which the wellsite is located in various embodiments.

The wellheads 104 are the surface interfaces for production and injection wells including connectors, valves, and the like for hookup to various rig equipment that pumps oil and gas from production tubing within the well or injects fluid into the production tubing from the surface. Such fluid may be intended for the production tubing itself, a fracture network accessed through perforations, or the reservoir to which the well is coupled. For example, cleaning fluid may be intended for the production tubing, fracturing or stimulation fluid may be intended for the fracture network, and water may be intended for the reservoir. The wellheads 104 may include spools, valves, and assorted adapters that provide pressure control of a production well. Additionally, the wellheads 104 may include a casing head, casing spools, casing hangers, isolation seals, test plugs, mudline suspension systems, tubing heads, tubing hangers, and a tubing head adapter.

The engine and pump equipment 106 may include motors, pumps, fans, and the like. The motor and pump equipment 106 produce much of the noise of well operations because of their speed and power. Specifically, the motors may produce several thousand horsepower each resulting in noise of over 100 decibels. Engines may be connected to electric generators, and electrical power may then be distributed by a silicon-controlled-rectifier system around the well operations site. For example, the motors may run a blender and pre-blender that mixes fluid for injection into the wellheads 104. Additionally, fans used to cool the well operations devices may be a source of noise.

Pumps may be used to move fluids in and out of the wellheads 104. As such, pumps may be coupled to the wellheads 104, a blender, a pre-blender, the sand and chemical additives trailers 108, and the water containers 110. The water containers 110 store water that may be added to injection fluid mixtures. For example, water may be pumped from the containers 110 to an industrial pre-blender that mixes powdered material with water, forming an injection gel, which is then pumped to the blender. Additionally, the sand and chemical additives trailers 108 store sand and chemical additives that may be added to injection fluids. The sand and chemical additives may be pumped from the trailers 108 to the blender, which mixes sand, chemical additives, injection gel, water, and the like into a homogenous fluid, which is then pumped to the wellheads 104 for injection into the wells. Although one configuration of well operation equipment has been described with respect to FIG. 1, the noise reduction concepts described below may be applied to many configurations of well operation equipment.

The passive sound barrier 112 shields an area in which the well operations are performed in an open-air environment. Because the well operations are not performed in an enclosed area, the noise from the well operations may escape the shielded area in many directions by traveling over the passive sound barrier 112. The passive sound barrier 112 may include walls, portable sound absorption panels, dirt berms, stacks of hay bales, mineral wool, sound blankets, concrete, steel composite panels, and the like.

The active anti-noise generators 114 may be movably fastened to the passive sound barrier 112 such that the positions and orientations of the active anti-noise generators may be adjusted. For example, the active anti-noise generators 114 may be mounted on rails fixed to the passive sound barrier 112. Accordingly, the horizontal or vertical spacing between the active anti-noise generators 114 may be adjusted, with or without human input, by sliding the active anti-noise generators 114 along the rails to new positions. Such horizontal and vertical spacing between the various active anti-noise generators 114 may be equal or unequal. Additionally, the active anti-noise generators 114 may be mounted on the rails using a ball and socket joint connector. Accordingly, the orientations of the active anti-noise generators 114 may be adjusted, with or without human input, by moving the balls within the sockets. The orientations of various active anti-noise generators 114 may be similar or different.

The active anti-noise generators 114 generate anti-noise that destructively interferes with noise from the well operations outside of the passive sound barrier 112. For example, each active anti-noise generator 114 may include a speaker assembly comprising a speaker and a sound sensor. Each speaker generates anti-noise based on an anti-noise signal produced by the command center 102. Specifically, the command center 102 includes an analysis module, which generates the anti-noise signal, coupled to the speakers using a wireless or wired connection. The sound sensors may also be coupled to the analysis module in the command center 102, using a wireless or wired connection, to provide feedback to the analysis module. For example, the sound sensors may receive and sample the near-field noise produced by the well operations and provide such samples to the analysis module. In various embodiments, the anti-noise signal provided to a speaker may be customized for that speaker or may be the same as anti-noise signals provided to one or more other speakers.

The analysis module generates the anti-noise signal based on one or more factors including, but not limited to, the near-field noise as sampled by the sound sensors, the distance between the passive sound barrier 112 and the location at which destructive interference should be maximized, the adjustable positions and orientations of the active anti-noise generators 114, and the like. Specifically, the near-field noise is the noise that should be interfered with by the anti-noise signal, and as such the anti-noise signal may be generated such that the anti-noise is equal in magnitude but opposite in phase at the location at which destructive interference should be maximized. For example, the near-field noise may be inverted to generate the anti-noise signal or provide a base anti-noise signal that may be subsequently modified according to other factors. As the near-field noise changes, the sampling by the sound sensors may reflect the changes, and the anti-noise signal may change proportionately based on new samples.

Next, the generation of the anti-noise signal may be based on the distance between the passive sound barrier 112 and the location at which destructive interference should be maximized. For example, in at least one embodiment the destructive interference should be maximized at a target subject to far-field noise outside the shielded area. Such a target may include, but is not limited to, a residential or business area, a wildlife area, a structure such as building or bridge, and the like. The distance between the target and the passive sound barrier 112 may be input at the command center 102 by a human or may be determined automatically, i.e. without human input. The command center 102 may model or simulate the propagation of anti-noise from the active anti-noise generators 114 over the predetermined distance in the direction of the target. For example, the command center 102 may construct a set of equations governing such propagation and may solve the set of equations for destructive interference of the far-field noise for the predetermined distance in the direction of the target. The destructive interference may be optimized by solving the equations using an iterative convergence technique, a cost-function technique, or a guess-and-check technique for a range of anti-noise signals from one or more active anti-noise generators 114. As a result of such solving, one or more active anti-noise generators 114 may be enabled or disabled, the anti-noise signals sent to one or more active anti-noise generators 114 may be adjusted or eliminated, and the like with or without human input.

The generation of the anti-noise signal may also be based on the adjustable positions and orientation of the active anti-noise generators 114. For example, in the modeling or simulation technique described above, the command center 102 may also model or simulate how the propagation of anti-noise changes as the vertical and horizontal location of one or more active anti-noise generators 114 is changed. The command center 102 may also model or simulate how the propagation of anti-noise changes as the orientations of one or more active anti-noise generators 114 is changed. As a result of solving the constructed equations, one or more active anti-noise generators 114 may be repositioned or reoriented with or without human input. Generally, the distance between multiple active anti-noise generators 114 may be increased when the distance between the target and the passive sound barrier increases, and the distance between multiple active anti-noise generators may be decreased when the distance between the target and the passive sound barrier decreases.

Figure 2:
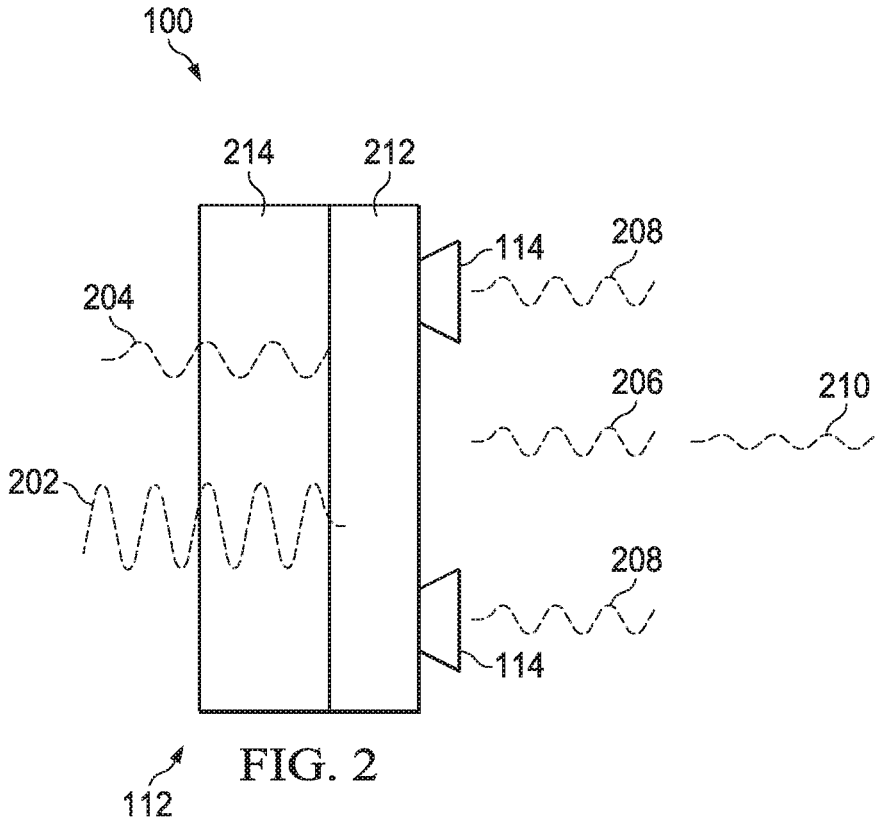
FIG. 2 is a diagram of an illustrative portion of a system of reducing far-field noise produced by well operations.

FIG. 2 is a diagram of an illustrative portion of a system 100 of reducing far-field noise produced by well operations. Specifically, a portion of the passive sound barrier 112 is shown. The passive sound barrier 112 includes two coupled portions 212, 214 of different material. In at least one embodiment, one portion 212 may include a concrete wall, while the second portion 214 includes a sound absorption panel. Two active anti-noise generators 114 are fastened to one portion 212 as described above. As shown in FIG. 2, the passive sound barrier 112 may receive source noise 202, or near-field noise, from the well operations. The passive sound barrier 112 may absorb a portion of the source noise 202, reflect a portion of the source noise 202, and transmit a portion of the source noise 202 resulting in reflected noise 204 and transmitted noise 206. The active anti-noise generators 114 each include a sound sensor, which samples the transmitted noise 206, and a speaker, which generates anti-noise 208 as described above. The anti-noise 208 destructively interferes with the transmitted noise 206 such that far-field noise 210 is many decibels lower than the transmitted noise 206.

In another embodiment, the sound sensor may be located within the area shielded by the passive sound barrier 112. As such, the near-field noise received by the sound sensor includes the source noise 202 and the reflected noise 204. In order to generate the anti-noise signal, the analysis module may predict the characteristics of the absorbed portion of the source noise 202 and transmitted noise 206 based on the source noise 202 and the reflected noise 204. Predicted absorption may be based on theoretical calculations or empirical measurements of the sound barrier 212 characteristics. The analysis module may invert the predicted transmitted noise 206 in order to generate the anti-noise signal as described above.

In another embodiment, the sound sensor may be above the passive sound barrier. As such, the near-field noise received by the sound sensor may include the source noise, and the analysis module may predict the characteristics of the absorbed portion of the source noise 202 and the transmitted noise 206. The analysis module may invert the predicted transmitted noise 206 in order to generate the anti-noise signal as described above.

Figure 3:
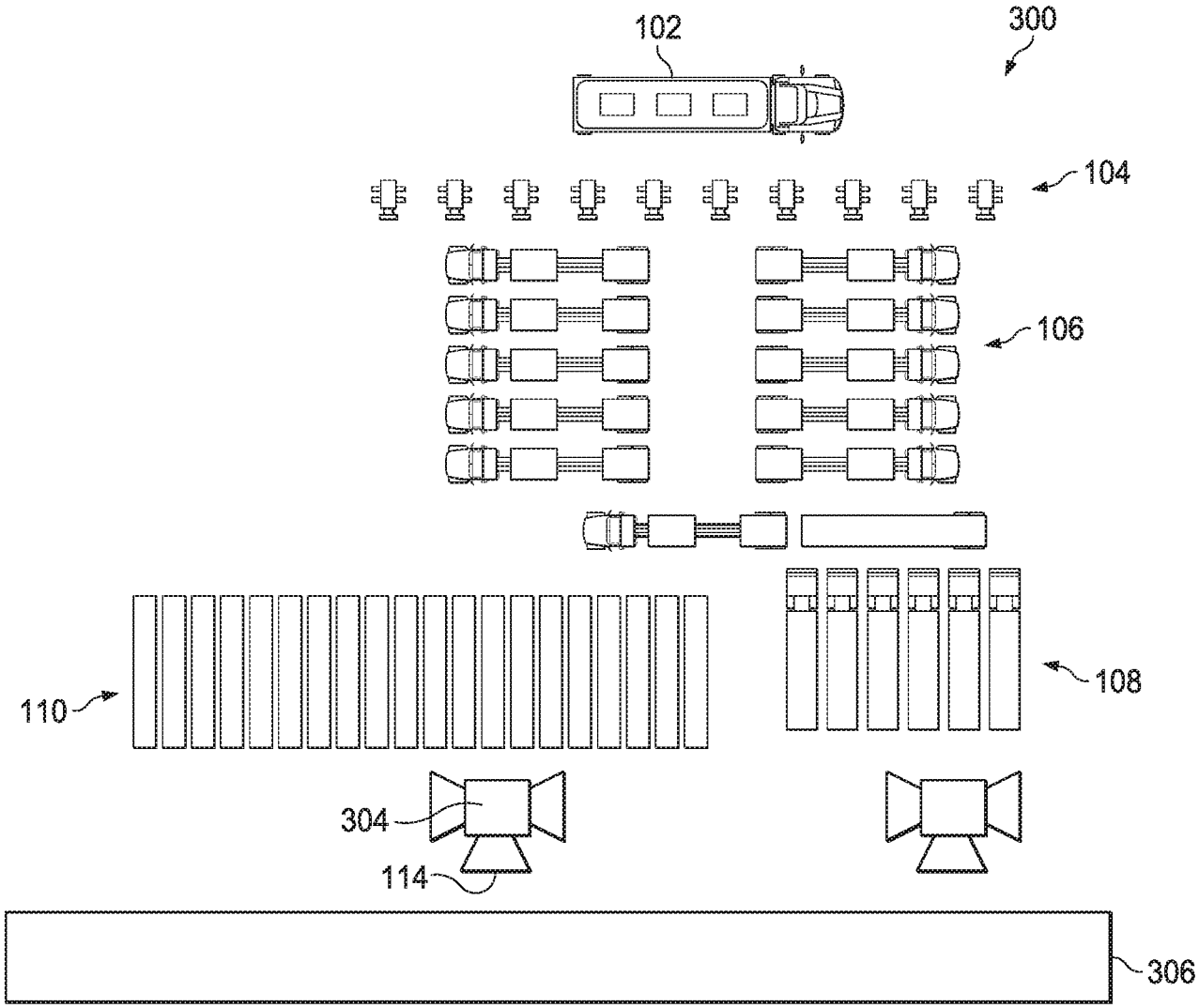
FIG. 3 is a diagram of another illustrative system of reducing far-field noise produced by well operations.

FIG. 3 is a diagram of another illustrative system 300 of reducing far-field noise produced by well operations. The system 300 of this figure is similar to the system 100 of FIG. 1, except the passive sound barrier has been eliminated. Additionally, the active anti-noise generators 114, instead of being fastened to the passive sound barrier, are fastened to a mobility unit 304 that makes the active anti-noise generators 114 mobile. The mobile active anti-noise generators 114 are coupled to the analysis module to generate anti-noise, based on the anti-noise signal, that destructively interferes with noise from the well operations as described above. The analysis module determines a distance between a target 306 and the mobile active anti-noise generators 304 at which destructive interference is optimized, and generates the anti-noise signal based on the noise, the distance, and adjustable positions and orientations of the mobile active anti-noise generators as described above. The mobile active anti-noise generators 304 may be positioned at the determined distance, unlike the system 100 of FIG. 1, using the mobility unit 304. In various embodiments, the mobility unit 304 may be a car, a wheeled vehicle, a moving platform, and the like. The mobile active anti-noise generators 304 may be positioned with human input or automatically, i.e. without human input. For example, the command center 102 may direct a self-driving anti-noise generator to move to the determined location. In another embodiment, a human may wheel the mobility unit 304 into place.

The analysis module may transmit the anti-noise signal to the mobile active anti-noise generators 114 such that the anti-noise signal reaches the mobile active anti-noise generators 114 ahead of noise with which the anti-noise signal is generated to destructively interfere. For example, the channel between the analysis module and the mobile active anti-noise generators 114 may enable communication faster than the speed of sound. As such, a sound sensor located near the well operations may sample near-field noise, and the analysis module may generate and communicate the anti-noise signal based on the near-field noise to the mobile active anti-noise generators 114 before the near-field noise, now far-field noise or transmitted noise, reaches the mobile active anti-noise generators 114. By positioning the mobile active anti-noise generators 114 near far-field noise, the amplitude of anti-noise that is generated to destructively interfere with the far-field noise is reduced compared to positioning the mobile active anti-noise generators 114 near the near-field noise. As such, the power requirements, cost, and size of the speakers necessary are reduced as well.

As the noise changes, the analysis module may determine a new distance between the target 306 and the mobile active anti-noise generators 114 at which destructive interference is optimized, and the mobile active anti-noise generators 114 may be positioned at the new distance.

Figure 4:
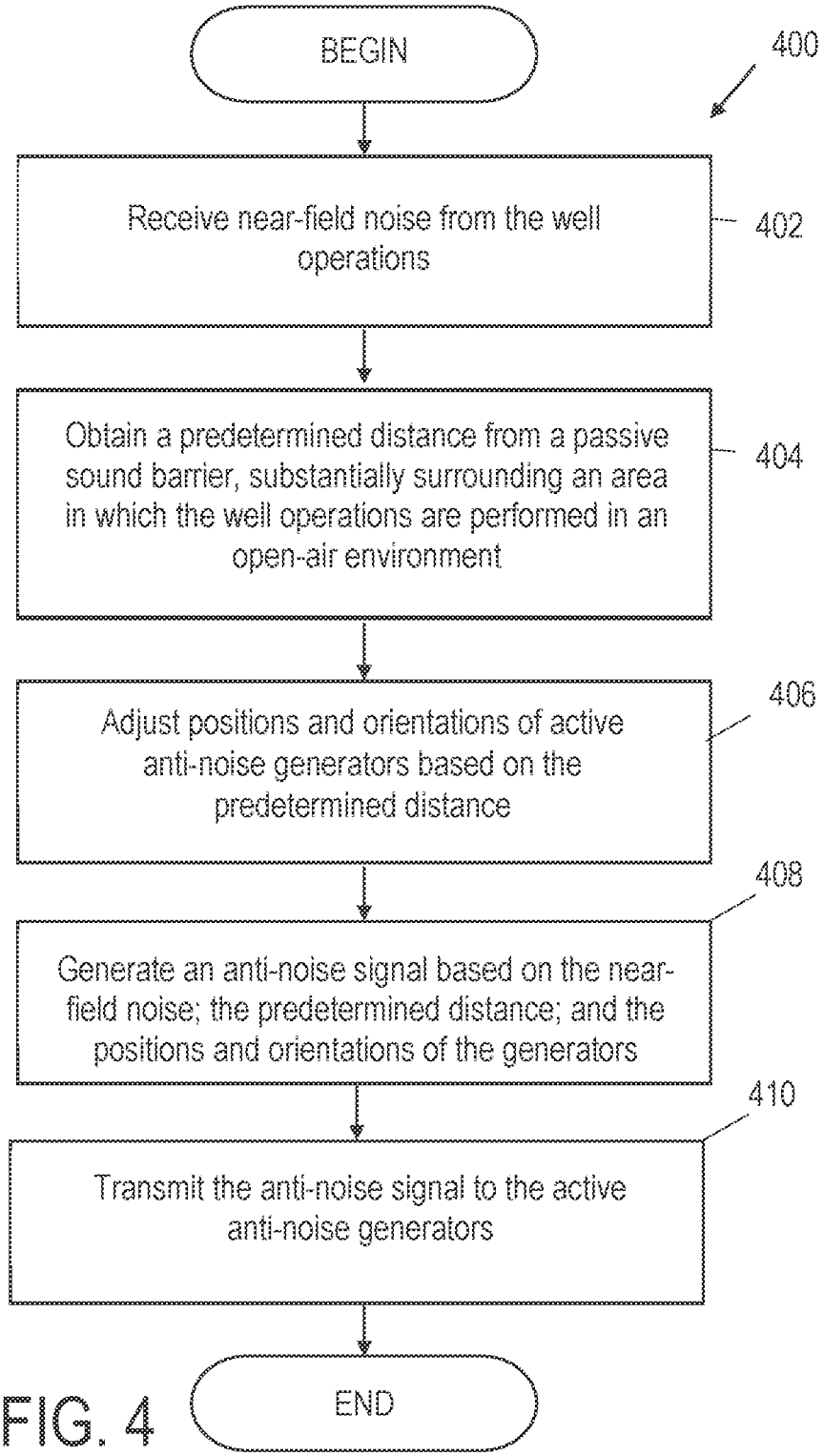
FIG. 4 is a flow diagram of an illustrative method of reducing far-field noise produced by well operations.

FIG. 4 is a flow diagram of an illustrative method 400 of reducing far-field noise produced by well operations that may be performed at least in part by one or more processors coupled to memory. The memory may include instructions, which when executed by the one or more processors, cause the one or more processors to perform an action described below. Also, the one or more processors may be part of a system 100 that implements an action described below. For example, the one or more processors may be located in the command center 102.

At 402, the system 100 receives near-field noise from the well operations. The passive sound barrier 112 may receive source noise from the well operations, absorb a portion of the source noise, reflect a portion of the source noise, and transmit a portion of the source noise. The near-field noise may be received within the shielded area or outside the shielded area, and may include different combinations of the portions depending on the location of the sound sensor. As such, the different portions may be directly measured or predicted based on other portions that are directly measured as described above. Receiving the near-field noise may include sampling the near-field noise slower than or equal to once every thirty seconds.

At 404, the system 100 obtains a predetermined distance from the passive sound barrier 112 to the target. For example, a worker may input the predetermined distance at the command center 102. In another embodiment, the distance is measured automatically, i.e. without human input. For example distance can be automatically measured by determining the time lag between the start or stop of noise sources and signal changes on the microphones. The time lag may be multiplied by the speed of sound to determine the distances.

At 406, the system 100 adjusts positions and orientations of active anti-noise generators 114 based on the predetermined distance. For example, the system 100 increases the distance between multiple active anti-noise generators 114 or decreases the distance between multiple active anti-noise generators 114 as the predetermined distance increases or decreases, respectively. Additionally, the orientations of the active anti-noise generators 114 may be adjusted as well. The adjustments may be made with or without human input based on the predetermined distance.

At 408, the system 100 generates an anti-noise signal based on the near-field noise, the predetermined distance, and the positions and orientations of active anti-noise generators as described above. At 410, the system 100 transmits the anti-noise signal to the active anti-noise generators 114 via a wired or wireless channel. The active anti-noise generators 114 generate anti-noise based on the anti-noise signal such that the anti-noise destructively interferes with the noise from the well operations, and such destructive interference is optimized for the predetermined distance. Specifically, the location of the most destructive interference is positioned at the predetermined distance in the direction of the target. In this way, well site operations may be performed closer to areas governed by noise regulation than may be performed by operators relying solely on passive sound barriers and attenuation distance of the noise produced by well operations.

Figure 5:
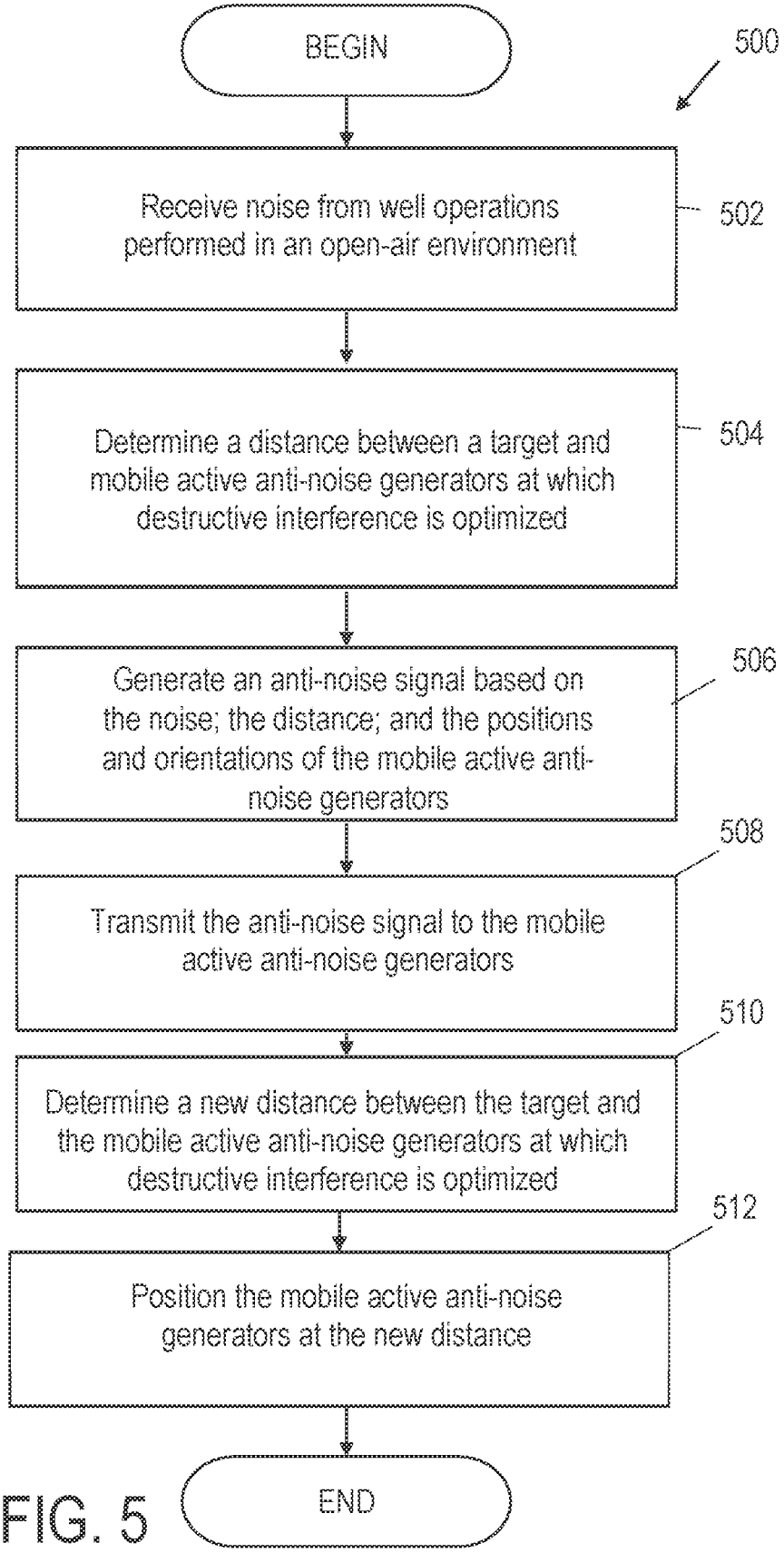
FIG. 5 is a flow diagram of another illustrative method of reducing far-field noise produced by well operations.

FIG. 5 is a flow diagram of another illustrative method of reducing far-field noise produced by well operations that may be performed at least in part by one or more processors coupled to memory. The memory may include instructions, which when executed by the one or more processors, cause the one or more processors to perform an action described below. Also, the one or more processors may be part of a system 300 that implements an action described below. For example, the one or more processors may be located in the command center 102.

At 502, the system 300 receives noise from well operations performed in an open-air environment. The noise may be received by sound sensors near the well operations or near a target 306 as described above. At 504, the system 300 determines a distance between the target and mobile active anti-noise generators 114, coupled to mobility units 304, at which destructive interference is optimized. The system 300 positions the mobile active anti-noise generators at the distance using the mobility units 304. At 506, the system 300 generates an anti-noise signal based on the noise, the distance, and the positions and orientations of the mobile active anti-noise generators as described above.

At 508, the system 300 transmits the anti-noise signal to the mobile active anti-noise generators 114. Transmitting the anti-noise signal may include transmitting the anti-noise signal to the mobile active anti-noise generators 114 such that the anti-noise signal reaches the mobile active anti-noise generators 114 ahead of noise with which the anti-noise signal is generated to destructively interfere. Subsequently, the mobile active anti-noise generators 114 generate the anti-noise based on the anti-noise signal, and the location of the most destructive interference between the anti-noise and the noise produced by the well operations is at the target 306. At 510, the system 300 determines a new distance between the target and the mobile active anti-noise generators at which destructive interference is optimized. For example, the noise produced by the well operations may have changed, necessitating a reevaluation of the optimization. At 512, the system 300 positions the mobile active anti-noise generators at the new distance. In this way, well site operations may be performed closer to areas governed by noise regulation than may be performed by operators relying solely on passive sound barriers and attenuation distance of the noise produced by well operations.

Figure 6:
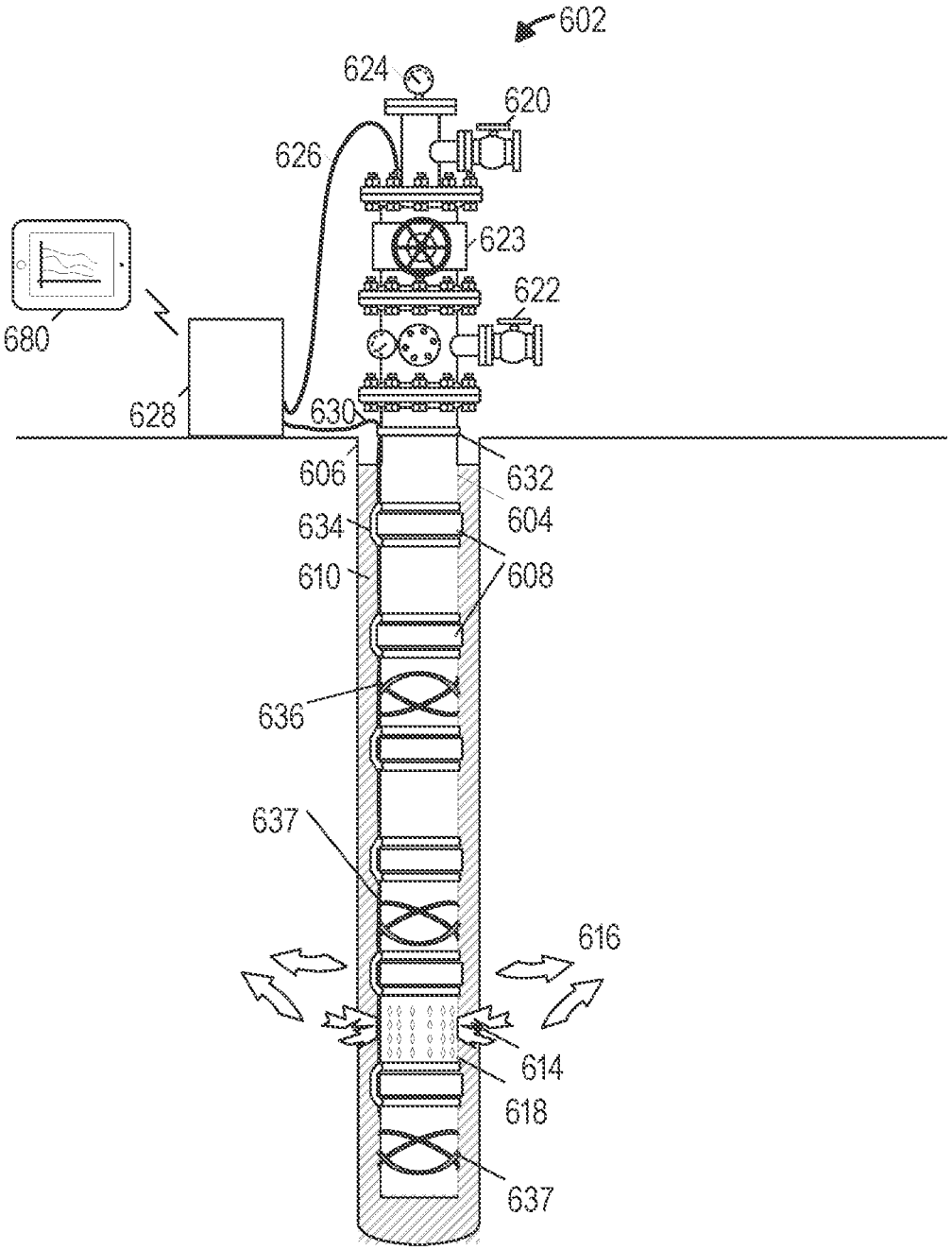
FIG. 6 is a contextual view of an illustrative well that may be included in a system of reducing far-field noise produced by well operations.

FIG. 6 is a contextual view of a well 602 that may be included in a system 100, 300 of reducing far-field noise produced by well operations. A casing string 604 is positioned in a borehole 606 that has been formed in the earth by a drill bit, and the casing string 604 includes multiple casing tubulars (usually 30 foot long steel tubulars) connected end-to-end by couplings 608. Alternative casing types include continuous tubing and, in some rare cases, composite (e.g., fiberglass) tubing. Cement 610 has been injected between an outer surface of the casing string 604 and an inner surface of the borehole 606, and the cement 610 has been allowed to set. The cement 610 enhances the structural integrity of the well and seals the annulus around the casing 604 against undesired fluid flows. Though well is shown as entirely cemented, in practice certain intervals may be left without cement, e.g., in horizontal runs of the borehole where it may be desired to facilitate fluid flows.

Perforations 614 have been formed at one or more positions along the borehole 606 to facilitate the flow of a fluid 616 from a surrounding formation into the borehole 606 and thence to the surface. The casing string 604 may include pre-formed openings 618 in the vicinity of the perforations 614, or it may be perforated at the same time as the formation. Typically, the well is equipped with a production tubing string positioned in an inner bore of the casing string 604. One or more openings in the production tubing string accept the borehole fluids and convey them to the earth's surface and onward to storage and/or processing facilities via a production outlet 620. The wellhead may include other ports such as a port 622 for accessing the annular space(s) and a blowout preventer 623 for blocking flows under emergency conditions. Various other ports and feed-throughs are generally included to enable the use of external sensors 624 and internal sensors. A cable 626 couples such sensors to a well interface system 628.

The interface system 628 typically supplies power to the transducers and provides data acquisition and storage, possibly with some amount of data processing. A monitoring system is coupled to the interface system 628 via an armored cable 630, which is attached to the exterior of the casing string 604 by straps 632 and protectors 634. Protectors 634 guide the cable 630 over the collars 608 and shield the cable 630 from being pinched between the collar 608 and the borehole wall. The cable 630 connects to one or more electromagnetic transducer modules 636, 637 attached to the casing string 604. Each of the transducer modules 636, 637 may include a layer of nonconductive material having a high permeability to reduce interference from casing effects.

The EM transducer modules 636 can transmit or receive arbitrary waveforms, including transient (e.g., pulse) waveforms, periodic waveforms, and harmonic waveforms. The transducer modules 637 can further measure natural EM fields including magnetotelluric and spontaneous potential fields. Without limitation, suitable EM signal frequencies for reservoir monitoring include the range from 1 Hz to 10 kHz. In this frequency range, the modules may be expected to detect signals at transducer spacings of up to about 200 feet, though of course this varies with transmitted signal strength and formation conductivity. Higher signal frequencies may also be suitable for some applications, including frequencies as high as 500 kHz, 2 MHz, or more.

FIG. 6 further shows a processor unit 680 that communicates wirelessly with the well interface system 628 to obtain and process measurement data and to provide a representative display of the information to a user. The processor unit 680 is coupled to memory, which includes executable instructions that, when executed, cause the one or more processors to perform an action described above with respect to FIGS. 4 and 5. The processor unit 680 may also communicate directly with the downhole environment. The processor unit 680 can take different forms including a tablet computer, laptop computer, desktop computer, and virtual cloud computer. The processor unit 680 may be included in the command center 202. The processor unit 680 may also be part of a distributed processing system including uphole processing, downhole processing, or both. Whichever processor unit embodiment is employed includes software that configures the unit's processor(s) to carry out an action described above and to enable the user to view and interact with a display of the resulting information.

In some aspects, systems and methods for reducing or eliminating far-field noise are provided according to one or more of the following examples. In at least one embodiment, a system for reducing far-field noise produced by well operations includes a passive sound barrier shielding an area in which the well operations are performed in an open-air environment. The system further includes a sound sensor to receive near-field noise from the well operations. The system further includes an analysis module, coupled to the sound sensor, to generate an anti-noise signal. The system further includes active anti-noise generators, coupled to the analysis module to generate anti-noise, based on the anti-noise signal, that destructively interferes with noise from the well operations outside of the passive sound barrier at a predetermined distance from the passive sound barrier. The analysis module generates the anti-noise signal based on the near-field noise, the predetermined distance, and adjustable positions and orientations of the active anti-noise generators.

In another embodiment, a method for reducing far-field noise produced by well operations includes receiving near-field noise from the well operations. The method further includes obtaining a predetermined distance from a passive sound barrier, which shields an area in which the well operations are performed in an open-air environment. The method further includes adjusting positions and orientations of active anti-noise generators based on the predetermined distance. The method further includes generating an anti-noise signal based on the near-field noise; the predetermined distance; and the positions and orientations of active anti-noise generators. The method further includes transmitting the anti-noise signal to the active anti-noise generators.

In another embodiment, a system for reducing far-field noise produced by well operations includes. The system further includes a sound sensor to receive noise from well operations performed in an open-air environment. The system further includes an analysis module, coupled to the sound sensor, to generate an anti-noise signal. The system further includes mobile active anti-noise generators coupled to the analysis module to generate anti-noise, based on the anti-noise signal, that destructively interferes with noise from the well operations. The analysis module determines a distance between a target and the mobile active anti-noise generators at which destructive interference is optimized, and generates the anti-noise signal based on the noise, the distance, and adjustable positions and orientations of the mobile active anti-noise generators. The mobile active anti-noise generators are positioned at the distance.

In another embodiment, a method for reducing far-field noise produced by well operations includes receiving noise from well operations performed in an open-air environment. The method further includes determining a distance between a distance between a target and mobile active anti-noise generators at which destructive interference is optimized. The method further includes generating an anti-noise signal based on the noise; the distance; and the positions and orientations of the mobile active anti-noise generators. The method further includes transmitting the anti-noise signal to the mobile active anti-noise generators.

The following features may be incorporated into the various embodiments described above, such features incorporated either individually in or conjunction with one or more of the other features. The active anti-noise generators may be movably fastened to the passive sound barrier such that the positions and orientations of the active anti-noise generators may be adjusted. The distance between multiple active anti-noise generators may be increased when the predetermined distance increases. The distance between multiple active anti-noise generators may be decreased when the predetermined distance decreases. The analysis module may determine the positions and orientations of the active anti-noise generators based on the predetermined distance. The positions and orientations of the active anti-noise generators may be automatically adjusted without human input based on the predetermined distance. The passive sound barrier may receive source noise from the well operations, absorb a portion of the source noise, reflect a portion of the source noise, and transmit a portion of the source noise. The sound sensor may be within the area, the near-field noise may include the source noise and the reflected portion, and the analysis module may predict the characteristics of the absorption portion and reflection portion. The sound sensor may be outside the area, and the near-field noise may include the transmitted portion. The sound sensor may be above the passive sound barrier, the near-field noise may include the source noise, and the analysis module may predict characteristics of the absorption portion. Adjusting the positions and orientations may include increasing the distance between multiple active anti-noise generators when the predetermined distance increases. Adjusting the positions and orientations may include decreasing the distance between multiple active anti-noise generators when the predetermined distance decreases. Adjusting the positions and orientations may include automatically adjusting the positions and orientations of the active anti-noise generators without human input based on the predetermined distance. The passive sound barrier may receive source noise from the well operations, absorb a portion of the source noise, reflect a portion of the source noise, and transmit a portion of the source noise. Receiving the near-field noise may include receiving the near-field noise within the area. The near-field noise may include the source noise and the reflected portion, and the method may include predicting the characteristics of the absorption portion and reflection portion. Receiving the near-field noise may include receiving the near-field noise outside the area, and the near-field noise may include the transmitted portion. Receiving the near-field noise may include receiving the near-field noise above the passive sound barrier. The near-field noise may include the source noise, and the method may include predicting characteristics of the absorption portion. Receiving the near-field noise may include sampling the near-field noise slower than or equal to once every thirty seconds. The far-field noise may be greater than one hundred feet from the source. The analysis module may transmit the anti-noise signal to the mobile active anti-noise generators such that the anti-noise signal reaches the mobile active anti-noise generators ahead of noise with which the anti-noise signal is generated to destructively interfere. The analysis module may determine a new distance between the target and the mobile active anti-noise generators at which destructive interference is optimized, and the mobile active anti-noise generators may be positioned at the new distance. Transmitting the anti-noise signal may include transmitting the anti-noise signal to the mobile active anti-noise generators such that the anti-noise signal reaches the mobile active anti-noise generators ahead of noise with which the anti-noise signal is generated to destructively interfere. The method may include positioning the mobile active anti-noise generators at the distance. The method may include determining a new distance between the target and the mobile active anti-noise generators at which destructive interference is optimized, and positioning the mobile active anti-noise generators at the new distance. A second sensor may measure the destructive interference via error in a wave match determination.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

What is claimed is:

1. A system for reducing far-field noise produced by well operations, the system comprising:

a passive sound barrier;

a sound sensor to receive near-field noise from the well operations;

an analysis module, coupled to the sound sensor, to generate an anti-noise signal; and active anti-noise generators, coupled to the analysis module, to generate anti-noise based on the anti-noise signal, wherein the anti-noise destructively interferes with noise from the well operations outside of the passive sound barrier at a predetermined distance from the passive sound barrier, wherein the analysis module generates the anti-noise signal based on the near-field noise, the predetermined distance, and simulations of various adjustable positions and orientations of the active anti-noise generators.

2. The system of claim 1, wherein the active anti-noise generators are movably fastened to the passive sound barrier, such that the positions and orientations of the active anti-noise generators may be adjusted.

3. The system of claim 1, wherein the analysis module determines the positions and orientations of the active anti-noise generators based on the predetermined distance.

4. The system of claim 1, wherein the positions and orientations of the active anti-noise generators are automatically adjusted without human input based on the predetermined distance.

5. The system of claim 1, wherein the passive sound barrier receives source noise from the well operations, absorbs a portion of the source noise, reflects a portion of the source noise, and transmits a portion of the source noise.

6. The system of claim 5, wherein the sound sensor is within an area shielded by the passive sound barrier, the near-field noise comprises the source noise and the reflected portion, and the analysis module predicts the characteristics of the absorption portion and transmitted portion.

7. The system of claim 5, wherein the sound sensor is outside an area shielded by the passive sound barrier, and the near-field noise comprises the transmitted portion.

8. The system of claim 5, wherein the sound sensor is above the passive sound barrier, the near-field noise comprises the source noise, and the analysis module predicts characteristics of the absorption portion.

9. The system of claim 5, further comprising a second sound sensor to measure the destructive interference via error in a wave match determination.

10. A method for reducing far-field noise produced by well operations, the method comprising:

receiving noise from the well operations;

obtaining at least one of a distance from a target to a passive sound barrier and a distance at which destructive interference is optimized between the target and active noise generators;

generating an anti-noise signal based on the noise, at least one of the obtained distances, and simulations of various positions and orientations of the active anti-noise generators; and transmitting the anti-noise signal to the active anti-noise generators.

11. The method of claim 10, wherein the noise comprises near-field noise, wherein the method comprises:

adjusting the positions and the orientations of active anti-noise generators based on at least one of the obtained distances.

12. The method of claim 10, wherein the passive sound barrier receives source noise from the well operations, absorbs a portion of the source noise, reflects a portion of the source noise, and transmits a portion of the source noise.

13. The method of claim 12, wherein receiving the noise comprises receiving a near-field noise within the area, wherein the near-field noise comprises the source noise and the reflected portion, and further comprising predicting the characteristics of the absorption portion and transmitted portion.

14. The method of claim 12, wherein receiving the noise comprises receiving a near-field noise outside the area, and wherein the near-field noise comprises the transmitted portion.

15. The method of claim 12, wherein receiving the noise comprises receiving a near-field noise above the passive sound barrier, wherein the near-field noise comprises the source noise, and further comprising predicting characteristics of the absorption portion.

16. The method of claim 10, further comprising obtaining a new distance in response to a change in the noise and readjusting the positions and orientations of the active anti-noise generators based on the new distance.

17. The method of claim 11, wherein adjusting the positions and orientations comprises automatically adjusting the positions and orientations of the active anti-noise generators without human input based on at least one of the obtained distances, and wherein transmitting the anti-noise signal comprises transmitting the anti-noise signal to the active anti-noise generators such that the anti-noise signal reaches the active anti-noise generators ahead of noise with which the anti-noise signal is generated to destructively interfere.

18. A system for reducing far-field noise produced by well operations, the system comprising:

a sound sensor to receive noise from the well operations performed in an open-air environment;

an analysis module, coupled to the sound sensor, to generate an anti-noise signal; and mobile active anti-noise generators coupled to the analysis module to generate anti-noise, based on the anti-noise signal, that destructively interferes with noise from the well operations, wherein the analysis module determines a distance at which destructive interference is optimized between the sound sensor and a target, and generates the anti-noise signal based on the noise, the distance, and simulations of various adjustable positions and orientations of the mobile active anti-noise generators, and wherein the mobile active anti-noise generators are positioned at the determined distance from the target.

19. The system of claim 18, wherein the analysis module transmits the anti-noise signal to the mobile active anti-noise generators such that the anti-noise signal reaches the mobile active anti-noise generators ahead of noise with which the anti-noise signal is generated to destructively interfere.

20. The system of claim 18, wherein the analysis module determines a new distance at which destructive interference is optimized between the sound sensor and the target, and the mobile active anti-noise generators are positioned at the determined new distance from the target.

* * * * *